US009403380B2

(12) United States Patent
Terrero et al.

(10) Patent No.: US 9,403,380 B2
(45) Date of Patent: Aug. 2, 2016

(54) MEDIA HEIGHT DETECTION SYSTEM FOR A PRINTING APPARATUS

(71) Applicant: Xerox Corporation, Norwalk, CT (US)

(72) Inventors: Carlos Manuel Terrero, Ontario, NY (US); Brian J. Dunham, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/541,280

(22) Filed: Nov. 14, 2014

(65) Prior Publication Data

US 2016/0136971 A1 May 19, 2016

(51) Int. Cl.

| | |
|---|---|
| ***B41J 29/38*** | (2006.01) |
| ***B41J 25/308*** | (2006.01) |
| ***B41J 29/393*** | (2006.01) |
| ***B41J 2/01*** | (2006.01) |
| ***B41J 11/00*** | (2006.01) |

(52) U.S. Cl.

CPC ..... *B41J 11/0005* (2013.01); *B41J 11/0095* (2013.01)

(58) Field of Classification Search

CPC .... B41J 29/393; B41J 25/308; B41J 11/0095; B41J 29/38; B41J 11/42; B41J 11/0005

USPC ..... 347/8, 14, 16, 19, 37, 101, 104

See application file for complete search history.

(56) References Cited

U.S. PATENT DOCUMENTS

2014/0098153 A1* 4/2014 Moore ..... B41J 11/0095 347/16

* cited by examiner

*Primary Examiner* — Jannelle M Lebron

(74) *Attorney, Agent, or Firm* — BudzynFortunato IP Law, LLC

(57) ABSTRACT

A media height detection system is used in connection with an inkjet printer. A filament is disposed above the process path and transverse to the process direction. A displacement sensor mounted adjacent the process path has a connecting member extending outward. The filament is attached to the connecting member and anchored to the printer. A transducer in the displacement sensor generates an electrical signal in response to a force on the filament. The filament contacts the lead edge of the sheet in the event of sheet curl in excess of a predetermined curl range. This will cause the force in the filament, which is conveyed to the displacement sensor to generate the signal. The print head can be elevated in response to the signal, so that the sheet does not impact the print heads, causing damage. Alternately, the sheet can be discarded.

7 Claims, 7 Drawing Sheets

MEDIA HEIGHT DETECTION SYSTEM FOR A PRINTING APPARATUS

INCORPORATION BY REFERENCE

Not applicable.

TECHNICAL FIELD

This invention relates to inkjet digital printing machines, and, more particularly, to an apparatus, system, and method for detecting excessive media height for protecting the printing head from damage by impaction of media sheets in an inkjet digital printing machine.

BACKGROUND

Digital printing machines can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art. The primary output product for a typical digital printing system is a printed copy substrate such as a sheet of paper bearing printed information in a specified format. More development is underway of production printers that require inkjet direct marking onto cut sheet media. This includes UV gel inks, solid inks and aqueous inks.

The output sheet can be printed on one side only, known as simplex, or on both sides of the sheet, known as duplex printing. In order to duplex print, the sheet is fed through a marking engine to print on the first side, then the sheet is inverted and fed through the marking engine a second time to print on the reverse side. The apparatus that turns the sheet over is called an inverter.

FIG. 1 shows a state-of-the-art inkjet digital printing machine 20. Printer 20 includes a marking module or engine 22 having a plurality of ink jet print heads 23, disposed centrally on the marking engine 22, and facing downward. Printer 20 has a media path 24 along which the media sheet 34 moves. Printer 20 has a media path entrance 26 where sheets are fed into the printer by a media sheet feeder (not shown). Printer 20 also has a media path exit 28 where sheets leave the printer and are fed into a finisher (not shown). Printer 20 has an inverter 30 to turn the sheet over for duplex printing. A media sheet 34 leaving the inverter 30 follows arrow 32 back to the marking engine 22 for printing on the reverse side. Arrows 26 and 28 also indicate the process path direction, which is downstream from entrance 26 toward exit 28.

In cut sheet printing devices, under certain conditions, the lead-edge of the paper can curl up and have potential for separating from the marking transport and contact the print head. A sheet with out-of-spec flatness can occur when a duplexed sheet has a heavy ink image on the trail edge of side 1, which then becomes the lead edge when inverted and curls towards Side 2. This is most severe when the paper is thin, and the cross-process direction image is parallel to the grain direction of the paper (Example: letter size paper, grain-long, long-edge-feed).

In direct-to-paper ink jet marking engines, an ink jet print head is mounted such that the face (where the ink nozzles are located) is mounted a fixed distance from the surface of the media. The gap is typically 1 mm or less. Because the paper curl height can be several millimeters, it poses a risk to the print head because it can hit the print head face plate when it passes through the nominally thin gap that the print heads are spaced from the media.

Media sheets, typically paper, can curl or distort in several ways. LE curl is a concave upward bending along the process direction, such that the lead edge (LE) and the trail edge (TE) rise up off the transport, as shown in FIG. 2. The raised LE can impact multiple print heads across the paper width. Cross curl is a concave upward bending across the process direction, such that the left side and right side edges rise up off the transport, as shown in FIG. 3. The raised sides can impact multiple print heads. Both LE curl and cross curl are caused by ink on the first side of a duplex print that is inverted.

Dog ear is a crease with upward bending across the process direction at an angle across a corner, as shown in FIG. 4. The crease can impact multiple print heads downstream. This is caused by sheet damage in the paper path. Print head damage is severe due to greater pressure.

Cockle is multiple bumps or peaks distributed throughout the sheet. The bumps can impact multiple print heads downstream. Cockle is caused by the drying rate of ink, especially aqueous based inks.

The print head gap or distance of the print head to the sheet must be within 1 mm. The media sheet must pass freely under the print heads. The sheet must not contact the face of the print head, or serious damage will result. This requirement poses a challenge for cut sheet media since the corners, edges and body of the sheet may not be completely flat. The use of a hold down transport such as a vacuum conveyor helps to maintain the sheet flat and within the gap for the most part. Purposely delivering sheets with downward curl from the sheet supply tray also helps to hold the sheet flat. Nevertheless it is not guaranteed that a sheet is flat over the entire surface.

Ink jet print heads are very delicate and can easily be damaged if the face of the print head is contacted by the media which is passing nearby. The print heads are also very expensive and thus, it is very important to minimize any risk of damaging these print heads.

Accordingly, there is a need to provide a system, for use with inkjet printers, for detecting excessive media height due to sheet curl so that remedial action can be taken to prevent print head damage.

There is a further need to provide a media height detection system of the type described and that will match the high production rate of a digital printing machine.

There is a yet further need to provide a media height detection system of the type described and that is mechanically simple and robust, thereby minimizing cost.

SUMMARY

In one aspect, a media height detection system is for use in connection with a printer having a print head. The print head is adapted for elevating. A media sheet has a lead edge and a trail edge, and moves in a process direction along a process path. The media height detection system comprises a displacement sensor mounted adjacent the process path. The displacement sensor is adapted to generate a signal in response to a force applied to the sensor.

A filament is disposed a predetermined distance above the process path and transverse to the process direction. The filament extends between a first end attached to the displacement sensor and a second end anchored to the printer. The filament is adapted for contacting the lead edge of the sheet in the event of sheet curl in excess of a predetermined curl range. This will cause the force in the filament. The force is conveyed to the displacement sensor to generate the signal in response to the filament contacting the sheet.

In another aspect, a media height detection system is for use in connection with a printer having a print head. The print head is adapted for elevating. A media sheet has a lead edge and a trail edge, and moves in a process direction along a process path. The media height detection system comprises a displacement sensor mounted adjacent the process path. The displacement sensor has a connecting member extending outward from the sensor. The displacement sensor has a transducer adapted for generating an electrical signal in response to a force on the connecting member.

A filament is disposed a predetermined distance above the process path and transverse to the process direction. The filament extends between a first end attached to the connecting member and a second end anchored to the printer. The filament is adapted for contacting the lead edge of the sheet in the event of sheet curl in excess of a predetermined curl range. This will cause the force in the filament. The force is conveyed to the displacement sensor to generate the signal in response to the filament contacting the sheet.

In yet another aspect, a method for detecting the height of a media sheet is for use in connection with a printer having a print head. The print head is adapted for elevating. A media sheet has a lead edge and a trail edge, and moves in a process direction along a process path. The method comprises mounting a displacement sensor including a transducer adjacent the process path. A connecting member extends outward from the displacement sensor. A filament is disposed a predetermined distance above the process path and transverse to the process direction. A first end of the filament is attached to the connecting member. A second end of the filament is anchored to the printer.

The filament is contacted with the lead edge of the sheet in the event of sheet curl in excess of a predetermined curl range. This causes a force in the filament by contacting the sheet. The force is conveyed to the connecting member. An electrical signal is generated with the transducer in response to the force on the connecting member.

These and other aspects, objectives, features, and advantages of the disclosed technologies will become apparent from the following detailed description of illustrative embodiments thereof, which is to be read in connection with the accompanying drawings.

It should be noted that the drawings herein are not to scale.

DETAILED DESCRIPTION

Describing now in further detail these exemplary embodiments with reference to the Figures as described above, the media height detection system is typically used in a select location or locations of the paper path or paths of various conventional media handling assemblies. Thus, only a portion of an exemplary media handling assembly path is illustrated herein.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" or "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" or "lead edge" (LE) of a media substrate refers to an edge of the sheet that is furthest downstream in the process direction.

As used herein, a "media handling assembly" refers to one or more devices used for handling and/or transporting media substrate, including feeding, printing, finishing, registration and transport systems.

As used herein, the terms "process" and "process direction" refer to a procedure of moving, transporting and/or handling a substrate media sheet. The process direction is a flow path the sheet moves in during the process.

Figure 1:
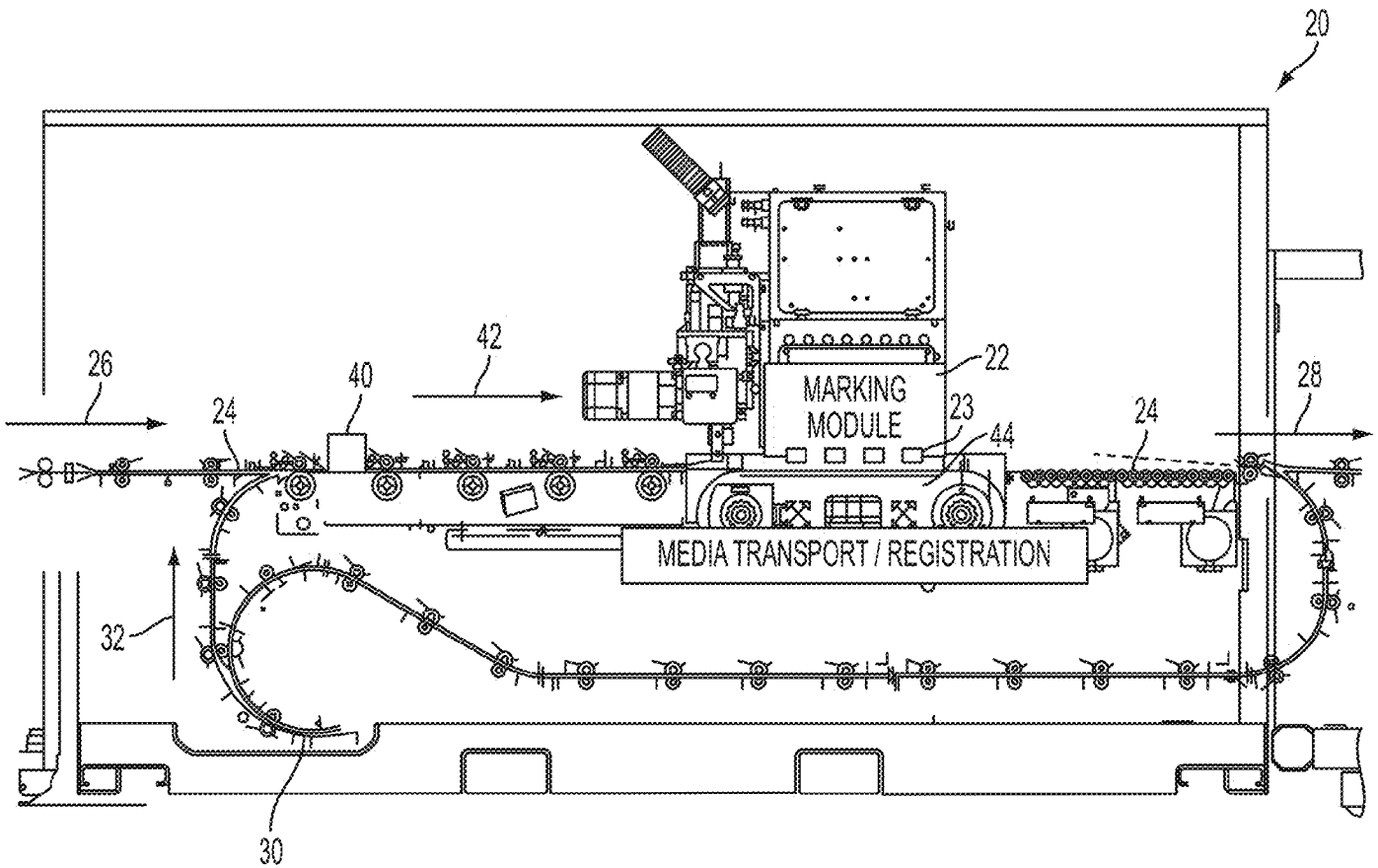
FIG. 1 is a schematic side elevational, sectional view of an exemplary production printer showing the position of a media height detection system constructed in accordance with the invention.
Figure 2:
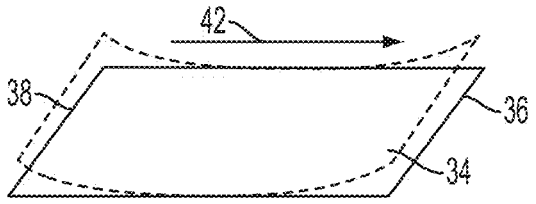
FIG. 2 is a schematic isometric view of a media sheet showing LE curl.
Figure 3:
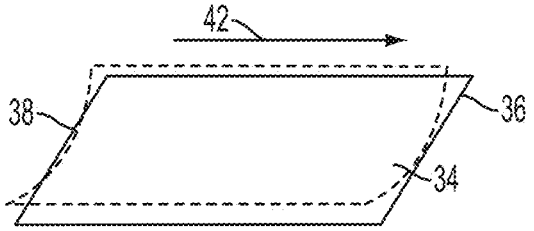
FIG. 3 is a schematic isometric view of a media sheet showing cross curl.
Figure 4:
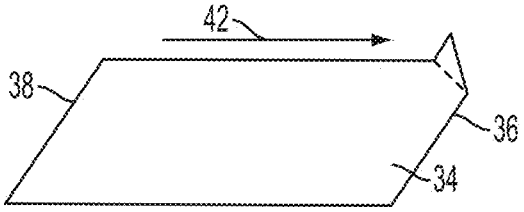
FIG. 4 is a schematic isometric view of a media sheet showing dog ear.
Figure 5:
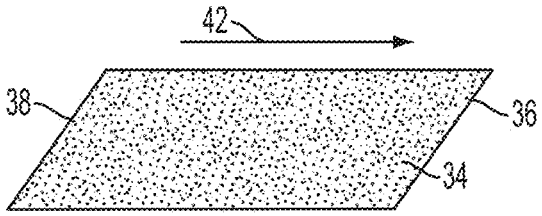
FIG. 5 is a schematic isometric view of a media sheet showing cockle.
Figure 6:
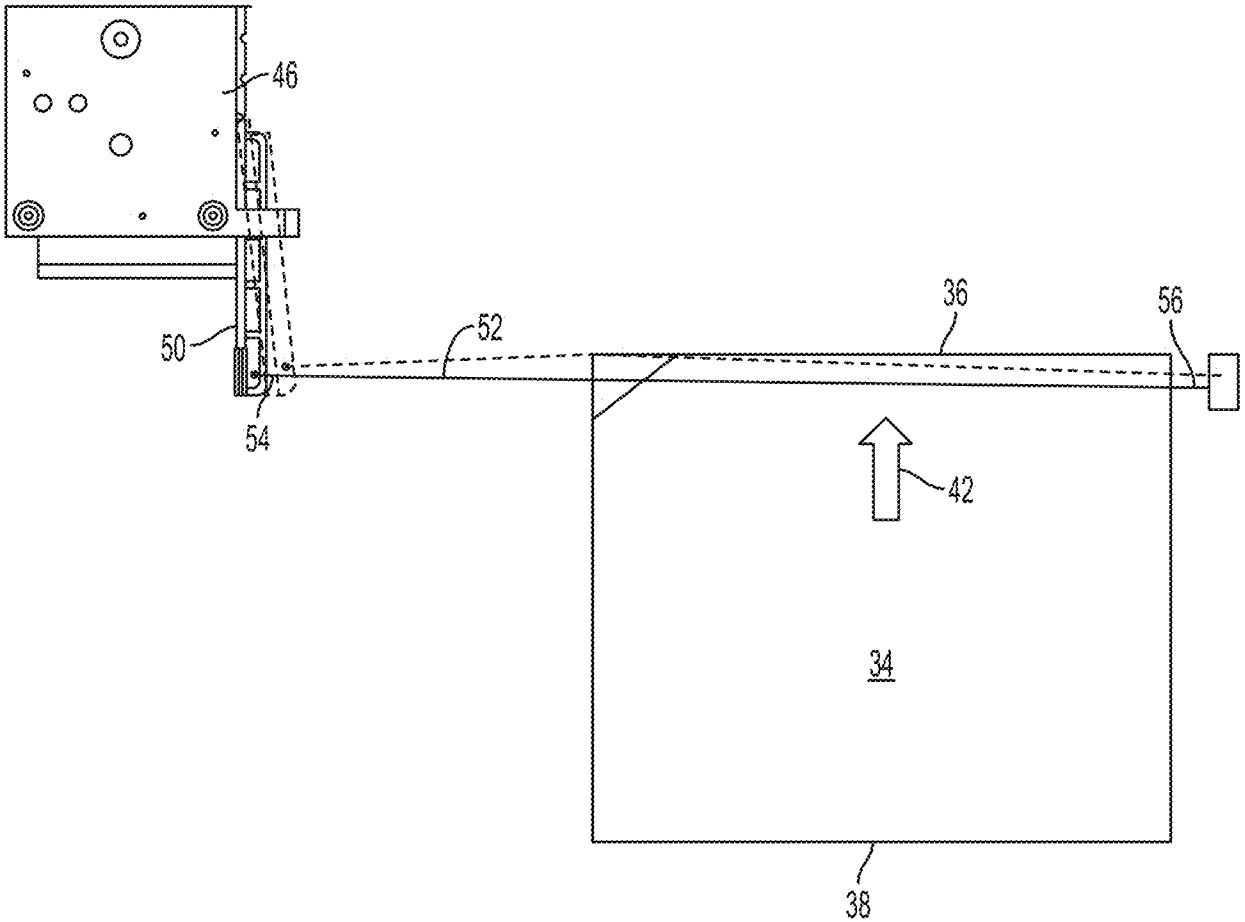
FIG. 6 is a schematic top plan view of the media height detection system of FIG. 1 with an incoming media sheet.
Figure 7:
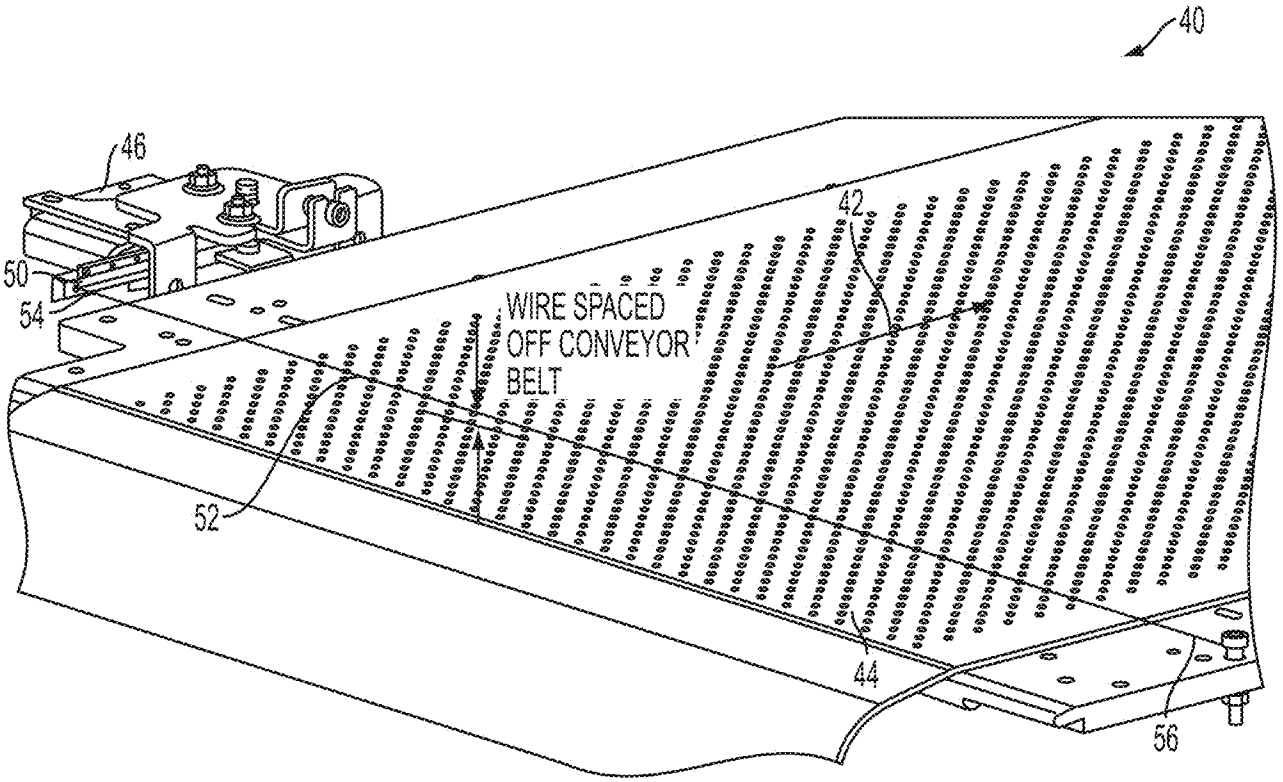
FIG. 7 is a perspective view of the media height detection system of FIG. 1.
Figure 8:
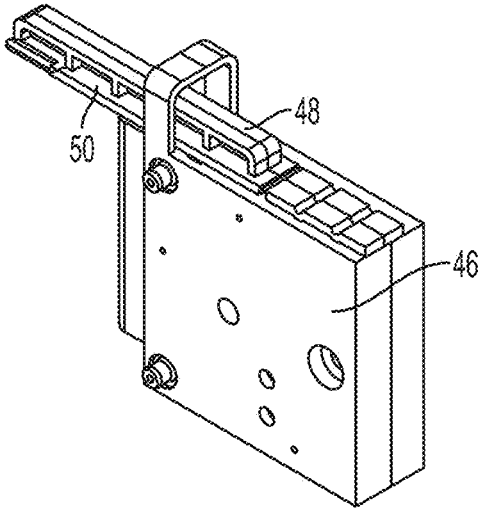
FIG. 8 is a perspective view of a sensor used with the media height detection system of FIG. 1.
Figure 9:
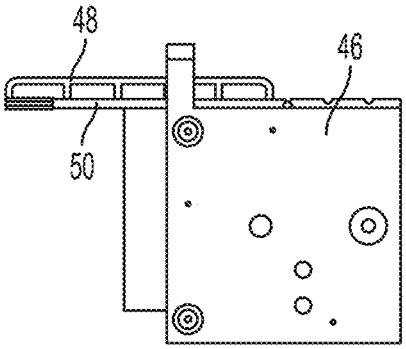
FIG. 9 is a top plan view of the sensor of FIG. 7.
Figure 10:
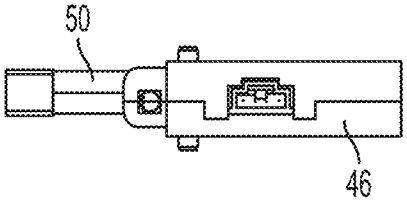
FIG. 10 is a front elevational view of the sensor of FIG. 7.
Figure 11:
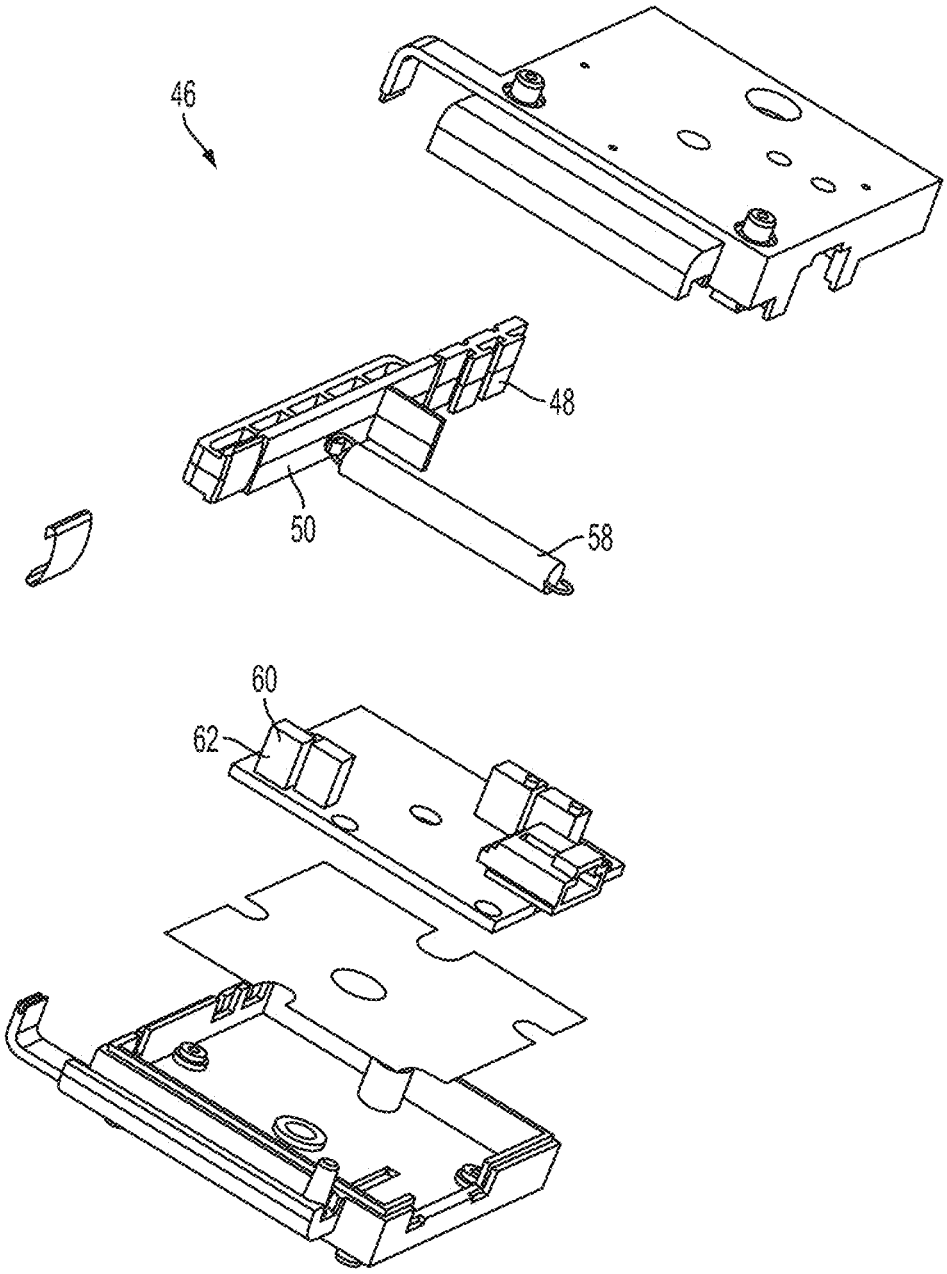
FIG. 11 is a perspective, exploded assembly view of the sensor of FIG. 7.
Figure 12:
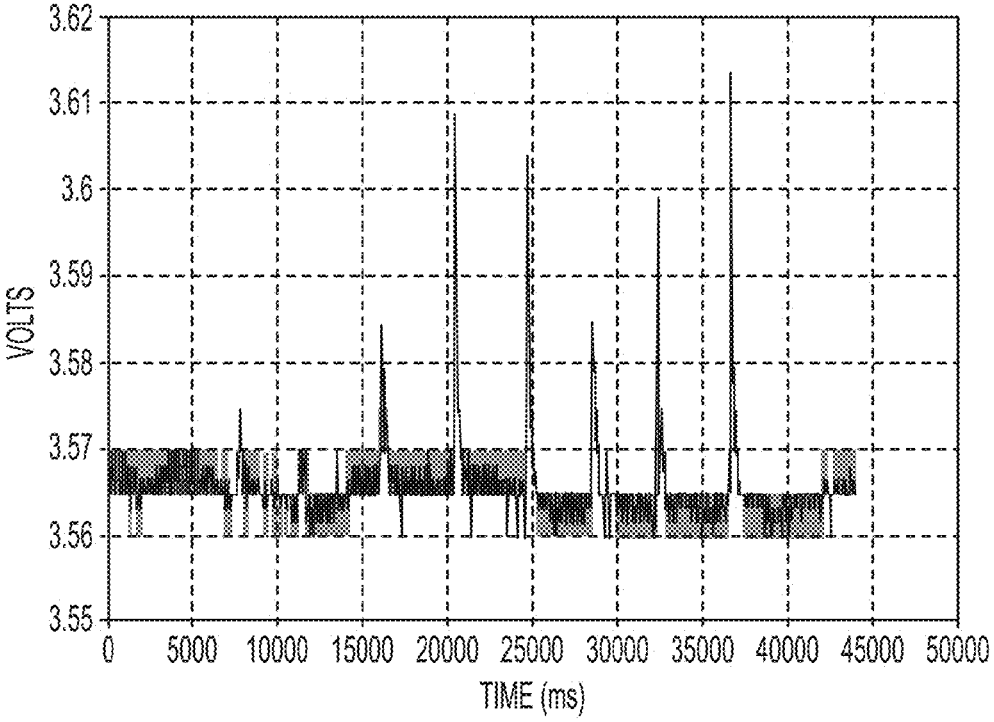
FIG. 12 is a graph of sensor voltage vs time, for sheets impacting the wire.

Referring to the drawing FIGS. 1-12, a media height detection system 40 is for use in connection with a printer, especially an inkjet printer 20 having an inkjet print head, and typically, a plurality of inkjet print heads 23. The print heads 23 are located on a marking module or engine 22, adapted for elevating, or being selectively raised above the transport 44. A media sheet 34 has a lead edge 36 and a trail edge 38. The media sheet 34 moves in a process direction (from left to right in FIG. 1) shown by arrow 42, along a process path 24 on a sheet transport 44, such as a vacuum transport. The media height detection system 40 comprises a displacement sensor 46 mounted adjacent the process path 24. The displacement sensor 46 has a connecting member 48 extending outward from the sensor 46. The connecting member 48 includes an arm 50 extending upstream.

A filament 52 is disposed a predetermined distance above the process path 24 and transverse to the process direction 42. The filament 52 extends between a first end 54 attached to the connecting member 48 and a second end 56 anchored to the printer 20. The filament 52 is positioned to contact the lead edge 36 of the sheet 34 in the event of sheet curl in excess of a predetermined curl range. This will cause the force in the filament 52. The force is conveyed to the displacement sensor 46 to generate the signal in response to the filament 52 contacting the sheet 34.

In the embodiment shown, the connecting member arm 50 extends upstream or counter to the process direction. It is to be understood that the connecting member 48 can extend in any direction, and that any direction will be considered equivalent within the spirit and scope of the claims. The arm 50 is attached transversely to the filament 52. The arm 50 is able to flex in response to the force. A spring 58 is attached to the arm 50 so as to tension the filament 52.

The displacement sensor 46 has a transducer 60 adapted for generating an electrical signal in response to a force on the connecting member 48. The signal is proportional to the force applied. The transducer 52 includes a photoreceptor 62, or similar photo-optical device. Alternatively, the transducer 52 can include a piezoelectric crystal, a capacitive or inductive device, or an electromagnetic device. In the embodiment shown, the photoreceptor 62 generates the electrical signal in response to the arm flexing.

The filament predetermined distance above the process path is the predetermined curl range, preferably within the range of 0.50 mm to 1.0 mm. Optionally, the range can be 0.40mm to 2.0 mm, or 0.30mm to 3.0 mm.

The filament 52 is made from a material capable of carrying a tensile load. The material, for example, can be selected from the group consisting of: metal wire; polymeric resin; carbon graphite; and plant fiber. It is to be understood that alternative materials will be considered equivalent within the spirit and scope of the claims.

Mitigation of print head damage is carried out in response to the signal. The mitigating means typically will include one of two procedures. The print head 23 can be elevated in response to the signal. The curled sheet 34 then passes below the raised print head 23, while receiving additional printing. The print head drawer, which is mounted on vertical slides, could be raised slightly (perhaps as much as 5 mm) to allow the out-of-spec paper to pass through without contacting the print head. Alternatively, the media sheet 34 can be directed away from the process path 24 in response to the signal. The media sheet 34 is then moved to a tray (not shown) for waste.

A method for detecting the height of a media sheet is for use in connection with a printer, and especially an inkjet printer 20 having an inkjet print head 23. The print head 23 is adapted for elevating. A media sheet 34 has a lead edge 36 and a trail edge 38, and moves in a process direction 42 along a process path 24. The method comprises mounting a displacement sensor 46 including a transducer 60 adjacent the process path 24. A connecting member 48 extends outward from the displacement sensor 46. A filament 52 is disposed a predetermined distance above the process path 24 and transverse to the process direction 42. A first end 54 of the filament 52 is attached to the connecting member 48. A second end 56 of the filament 52 is anchored to the printer 20.

The filament 52 is contacted with the lead edge 36 of the sheet 34 in the event of sheet curl in excess of a predetermined curl range. This causes a force in the filament 52 by contacting the sheet 34. The force is conveyed to the connecting member 48. An electrical signal is generated with the transducer 60 in response to the force on the connecting member 48.

An arm 50 of the connecting member 48 is attached transversely to the filament 52. The filament 52 is tensioned by attaching a spring 58 to the arm 50. The arm 50 flexes in response to the force. A photoreceptor 62 is included in the transducer 60. An electrical signal is generated with the photoreceptor 62 in response to the arm 50 flexing.

The filament 52 is disposed above the process path a distance within the range of 0.50 mm to 1.0 mm. Alternative distances range from 0.40 mm to 2.0 mm and from 0.30 mm to 3.0 mm.

The print head 23 can be elevated in response to the signal. Alternatively, the media sheet 34 can be directed away from the process path 24 in response to the signal.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A media height detection system for use in connection with a printer having a print head, the print head being adapted for elevating, and a media sheet having a lead edge and a trail edge, the media sheet moving in a process direction along a process path, the media height detection system comprising:

a displacement sensor mounted adjacent the process path, the displacement sensor being adapted to generate a signal in response to a force applied to the sensor;

a filament disposed a predetermined distance above the process path and transverse to the process direction, the filament extending between a first end attached to the displacement sensor and a second end anchored to the printer, the filament being adapted for contacting the lead edge of the sheet in the event of sheet curl in excess of a predetermined curl range, so as to cause the force in the filament, and to convey the force to the displacement sensor to generate the signal in response to the filament contacting the sheet;

wherein the printer is an inkjet printer having an inkjet print head, wherein the displacement sensor further comprises the media height detection system further comprising:

a connecting member extending outward from the sensor, the filament being attached to the connecting member to convey the force to the connecting member;

wherein the displacement sensor further comprises a transducer adapted to respond to the force on the connecting member, the transducer being adapted for generating the signal proportional to the force; and wherein the signal is an electrical signal; and wherein the displacement sensor further comprises:

the connecting member includes an arm attached transversely to the filament, the arm being adapted for flexing in response to the force;

a spring attached to the arm so as to tension the filament;

and the transducer includes a photoreceptor adapted to respond to the arm flexing.

2. The media height detection system of claim 1, wherein the print head is adapted to be elevated in response to the signal.

3. The media height detection system of claim 1, wherein the media sheet is adapted to be directed away from the process path in response to the signal.

4. The media height detection system of claim 1, wherein the filament predetermined distance above the process path is within the range of 0.50 mm to 1.0 mm.

5. The media height detection system of claim 1, wherein the filament predetermined distance above the process path is within the range of 0.40 mm to 2.0 mm.

6. The media height detection system of claim 1, wherein the filament predetermined distance above the process path is within the range of 0.30 mm to 3.0 mm.

7. The media height detection system of claim 1, wherein the filament comprises a material adapted to carry a tensile load selected from the group consisting of:

metal wire;
polymeric resin;
carbon graphite;
glass fiber; and
plant fiber.

* * * * *